United States Patent [19]

Damm

[11] Patent Number: 4,656,846

[45] Date of Patent: Apr. 14, 1987

[54] APPARATUS FOR DYEING CELLULOSE FIBER MATERIAL BY CONTROLLED ADDITION OF ALKALINE MATERIAL

[75] Inventor: Sture Damm, Borås, Sweden

[73] Assignee: Adcon AB, Borås, Sweden

[21] Appl. No.: 815,896

[22] Filed: Jan. 3, 1986

Related U.S. Application Data

[62] Division of Ser. No. 589,475, Mar. 14, 1984, Pat. No. 4,562,604.

[30] Foreign Application Priority Data

Mar. 18, 1983 [SE] Sweden ..... 8301484

[51] Int. Cl.[4] ..... D06B 3/02; D06B 3/28

[52] U.S. Cl. ..... 68/207; 68/177

[58] Field of Search ..... 68/177, 178, 207; 222/309

[56] References Cited

U.S. PATENT DOCUMENTS

| | | | |
|---|---|---|---|
| 2,583,267 | 1/1952 | Jones et al. | 68/207 X |
| 3,971,236 | 7/1976 | Bene | 68/177 X |
| 4,228,924 | 10/1980 | Gilbert | 222/309 X |
| 4,369,898 | 1/1983 | Andersson | 222/309 X |
| 4,546,624 | 10/1985 | Von der Eltz et al. | 68/207 X |

*Primary Examiner*—Philip R. Coe

[57] ABSTRACT

Apparatus including a vessel for dyeing cellulose fibers in a bath containing a reactive dyeing agent and an alkaline material for fixation thereof, a pump for progressively adding the alkaline material to the bath in a continuous and automatic manner over a predetermined time interval, and an electronic control system for regulating the amount of alkaline material added, the amount being limited initially and increased in a final phase of addition until a sufficient amount is added to fix the dyeing agent. The pump is of the reciprocating piston type, the length and frequency of the strokes thereof being regulated by the control system.

2 Claims, 5 Drawing Figures

Figure 1:
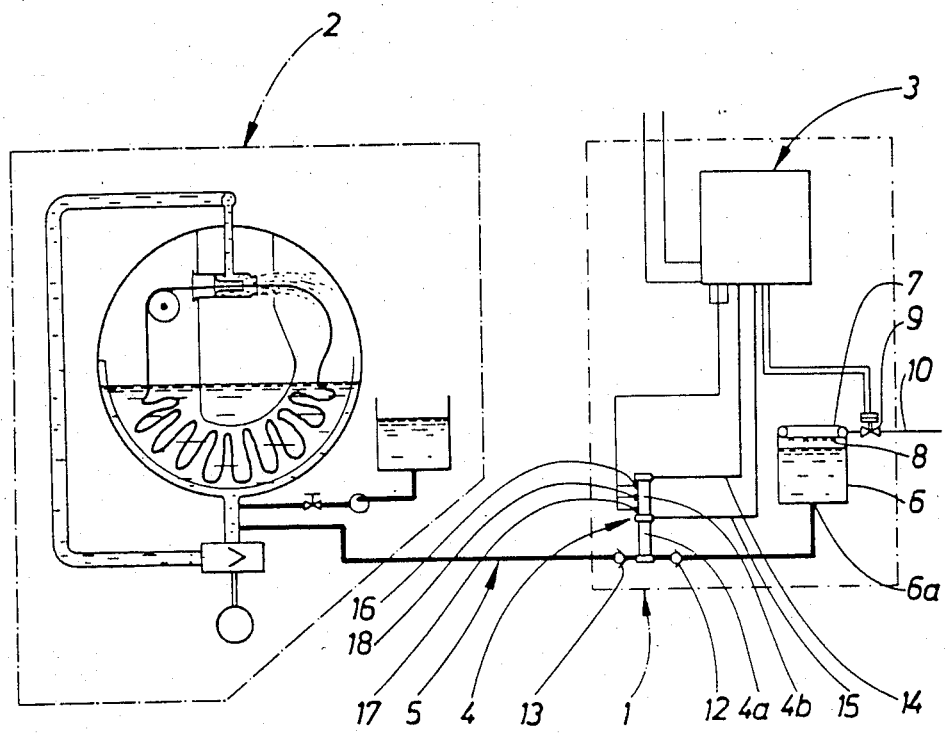

APPARATUS FOR DYEING CELLULOSE FIBER MATERIAL BY CONTROLLED ADDITION OF ALKALINE MATERIAL

This is a division of application Ser. No. 589,475, filed Mar. 14, 1984, and now U.S. Pat. No. 4,562,604.

The present invention relates to a method for dyeing of cellulose fiber material or mixtures containing such material by means of one or several reactive dyeing agents by addition of an alkali to a dye bath which includes said dyeing agents and in which the fiber material is placed, said alkali influencing the fixation of the dyeing agents to the fiber material.

The present invention also relates to a device for accomplishment of a method for dyeing cellulose fiber material or mixtures containing such material by means of one or several reactive dyeing agents by addition of alkali to a dye bath which includes said reactive dyeing agents and in which the fiber material is placed, said alkali influencing the fixation of the dyeing agents to the material.

The present invention is especially adapted for dyeing by means of reactive dyeing agents. The dyeing agents in the shape of a water soluble dye in the presence of alkali and electrolytes are brought into contact with the fiber; the proportions between fiber material and dye bath can range between 1:2 to 1:100, usually 1:5 to 1:30. The alkali used, depending on the reactivity of dyeing agents is for example sodium bicarbonate, sodium carbonate, trisodium phosphate, sodium metasilicate or caustic soda. Also mixtures of said alkalies with each other and with alkali binding agents can be utilized. The temperature of use is between 20° and 130° C., preferably between 30° and 95° C.

If one used reactive dyeing agents and optimum dyeing temperature of the dye bath, containing dyeing agent and electrolyte, adds all necessary alkali initially, one obtains with a great likelihood an uneven dyeing, as the fixation to the fibers is initiated at a high speed and reaches after a few minutes high values. On the other hand one can not reduce the amount of alkali, as it is necessary for attaining the end fixation value at a certain given dyeing time and consequently necessary for the reproduceability of the dyeing. These facts are known in several publications, for example in "Mustercarte Le 1350" from Bayer AG. In order to retain the increase of the fixation in the initial stage of the dyeing method, different methods have been recommended. They are illustrated by methods A and B as described below or combinations of these methods.

METHOD A

The dyeing process is started below the required or recommended dyeing temperature, for example at 20° C. Dye stuff, electrolyte and alkali is added in an arbitrary sequence, possibly in portions. Then the temperature is increased after some time slowly to a prescribed value, for example 60° C. and the material to be dyed is treated a certain time, for example 60 minutes at this temperature and the fixation takes place.

The intention with the above mentioned measure is clear: As the speed of reaction is depending on the temperature the fixation to the fibers is retained at a lower initial temperature so that too steep rise of the fixation curve is avoided. However method A has considerable drawbacks. At the so called warm dyeing reactive dye stuffs (dyeing agents) which mostly are employed at 40° to 50° C., this measure will not be too effective, as between the initial treatment temperature and the final treatment temperature a relative small difference is present. Using different machines and especially at tropical temperatures or summer temperatures initial temperatures below 30°–40° C. are in many cases impossible. Low treatment temperatures are counterproductive in other ways, for example:

(1) In existing dyeing machines the friction properties of the goods are influenced considerably. The machines run poorly and the strings of goods will often get stuck.

(2) In winch dyeing machines the goods will often stick. They will not open, resulting in that danger for formations of folds increases.

(3) In cheese dyeing machines the flow and consequently the speed of circulation of a time unit of the bath will be reduced.

METHOD B

The alkali is added and after that the recommended dyeing temperature has been reached. As one can expect a not desired fast start of the fixation, the required amount of alkali must in usual manner be added in portions and at time intervals.

In British patent specification, publication number 1 458 623, which substantially refers to dyeing of wool and polyamide fibres in an acid environment, it is suggested to dye cellolose fibers by means of reactive dyeing agents at a constant temperature, whereas by the corresponding addition of alkali the pH-value is slowly controlled to a desired final value. However, in 1963 Kiehslich (Deutscher Färber kalender, page 9 and forwards: Modificationen des Ausziehverfahrens beim Färben mit Remazol Farbstoffen) a method at which the alkality at a constant dyeing temperature slowly, starting with a sodium bicarbonate/sodium carbonate buffer is placed in an area for caustic soda over the step of sodium carbonate.

The problem with method B lies in that primarily with strongly dissociated alkalies already high pH-values are attained at very small amounts. As small as 0.1 g/l caustic soda influences the pH-value by eleven. However, the pH-value of the dye bath is not a very advantageous basis for the control of the dyeing process. Important for the fixation process is rather the so called internal pH-value for the fibers which is higher than the external pH-value which is the pH-value of the bath, which two values however do not correspond to each other. This internal pH-value depends on the type of gods to be dyed, the alkali used, the length of the bath, the temperature used and the electrolyte concentration.

It shall also be mentioned that because of the ionization of the primary hydroxyl groops caused by the addition of the alkali, there is increasingly built up a negative potential in the cellulose fibres which repells the correspondingly charged dyed stuff aniones. If the addition of alkali does not takes place in sufficiently small steps already transferred parts of the dye stuffs can be dissolved and this is also disadvantageous for evenness in the dyeing process. From the above it is apparent that in connection with method B the addition of alkali must take place with great accuracy and good knowledge of the process. It is further disadvantageous that this method is too much dependent on the know-how of the service personnel.

The object of the present invention is to provide a method and a device by means of which the above disadvantages are eliminated.

Said objects are achieved by means of a method according to the present invention, which is characterized by adding said alkali continuously or substantially continuously over a predetermined time interval progressively so that the addition is started with a limited amount per time unit in an initial phase of said time interval and the addition thereafter is increased to a largest amount a time unit in per final phase of said time interval until a certain amount necessary for the dyeing process has been added, said addition being controlled automatically following a predetermined function of time.

Said object is also achieved by means of a device according to the present invention, which is characterized by a control unit and a pump unit, said control unit being provided to control the pump unit for automatic progressive addition of a certain amount of the alkali as a predetermined function of time over a predetermined time interval, so that in an initial phase of said time interval a limited amount of the alkali is added per time unit, which in a final phase of said addition changes to a largest amount per time unit, until a certain amount necessary for the dyeing process has been added.

According to the present invention the reaction of the reactive dyeing agent with the cellulose fibers can be controlled so that the degree of the fixation takes place proportionally by time during the main part of the time interval, during which alkali is added. By means of the device according to the present invention there is obtained a great accuracy in the addition of alkali by eliminating manual handling.

Figure 2:
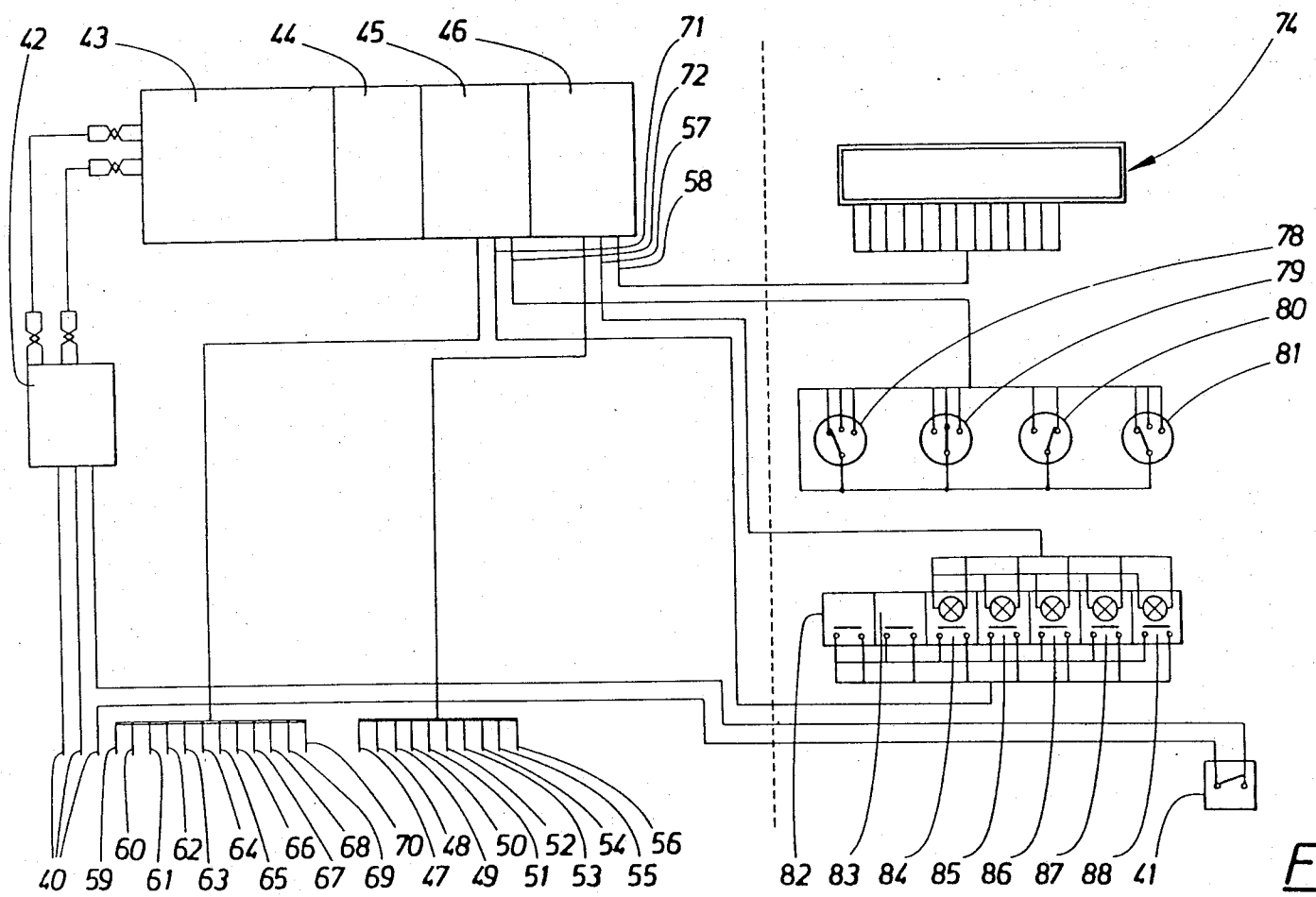
Figure 3:
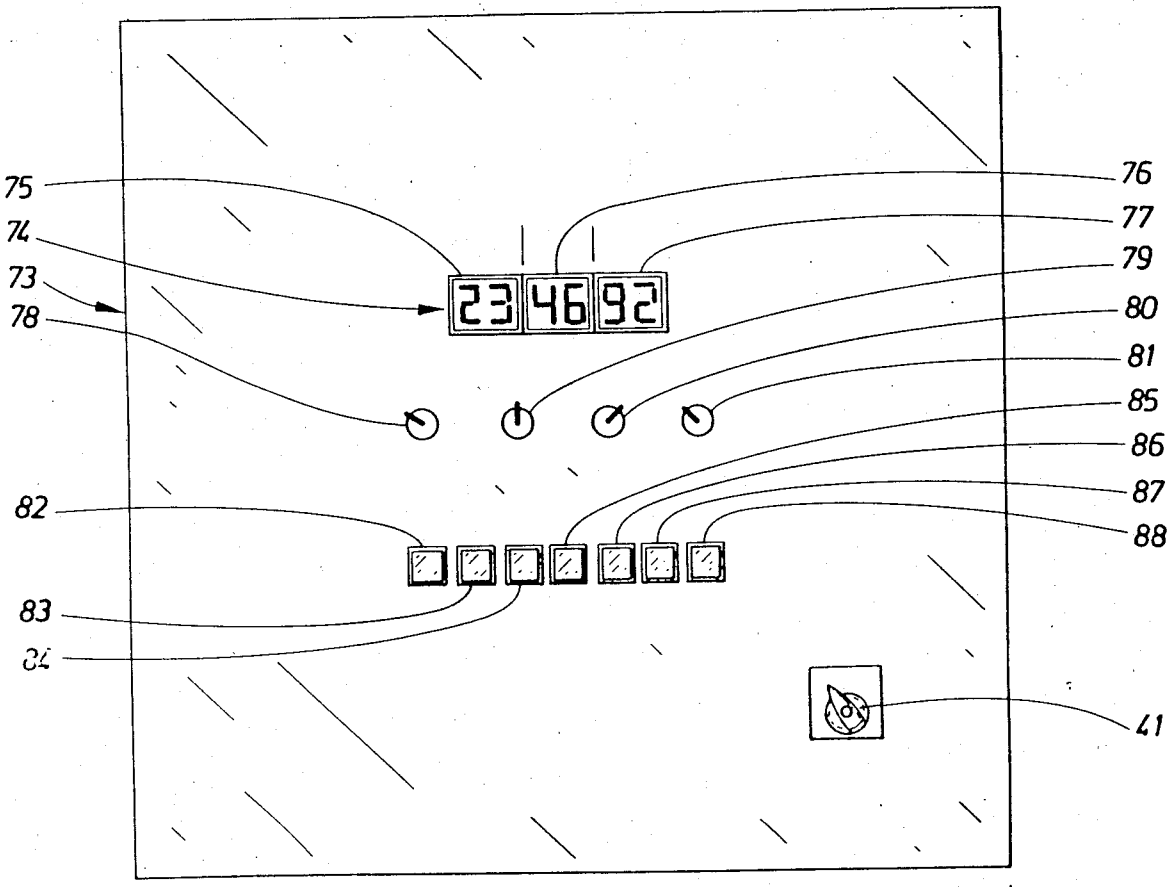
Figure 4:
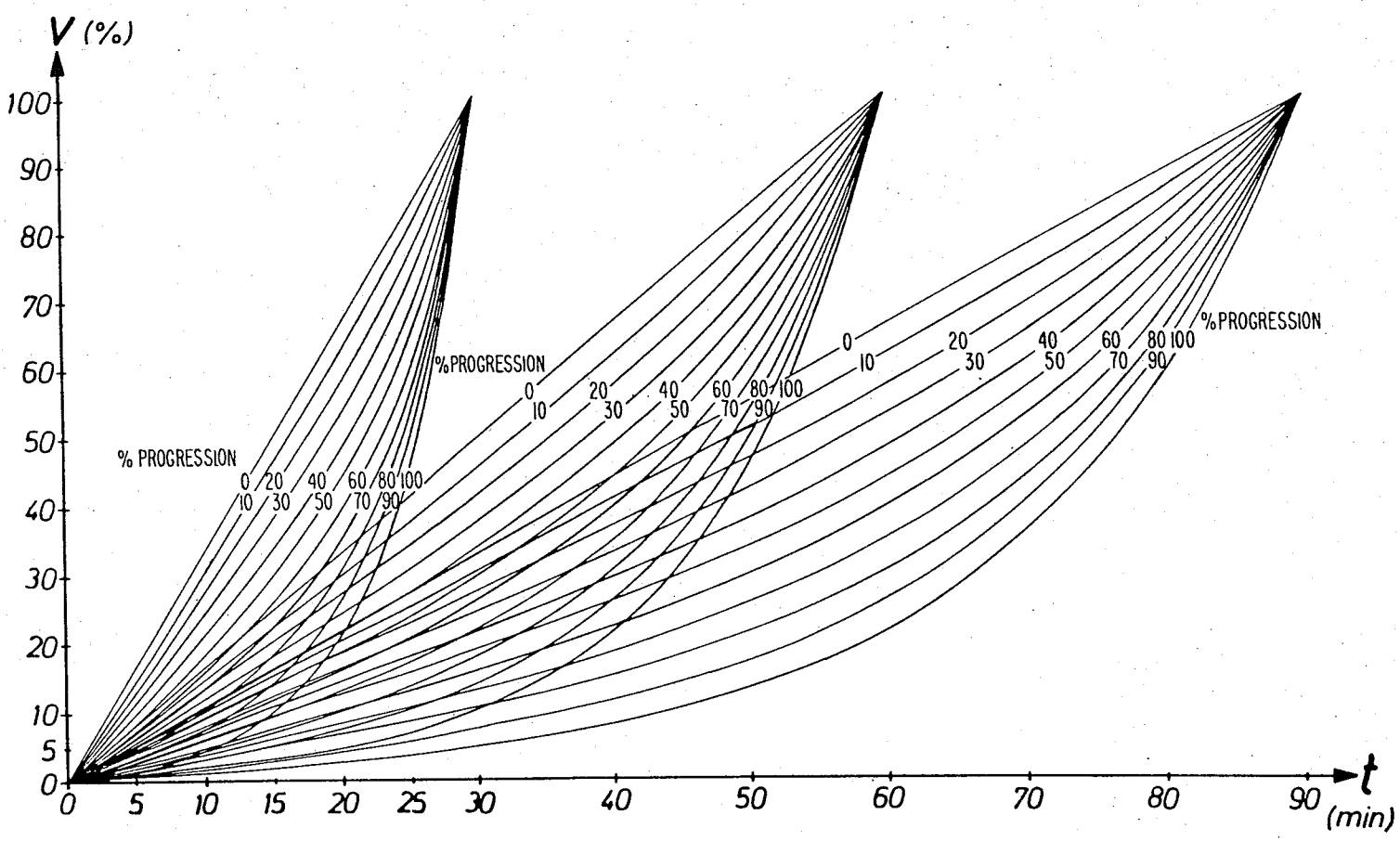
Figure 5:
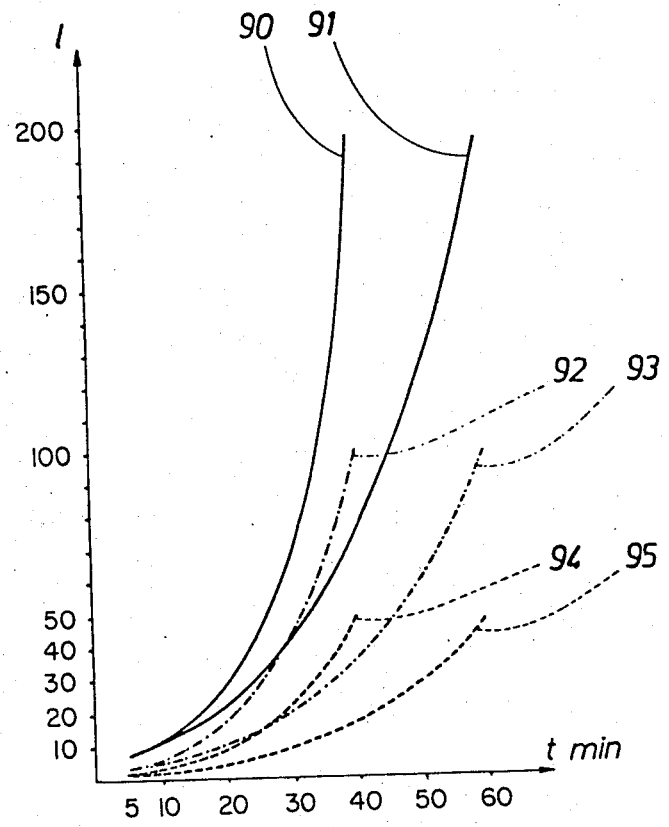

The invention is more precisely described in the following embodiment with reference to the enclosed drawings, in which FIG. 1 schematically shows a dyeing machine provided with a device according to the present invention, FIG. 2 shows schematically the design of a control unit included in the device, FIG. 3 shows a panel belonging to the control unit, FIG. 4 and FIG. 5 show different curves representing different amount/time functions according to which alkali is added according to the present invention.

FIG. 1 shows an example of a device 1 for the addition of an agent for treatment according to the invention, connected to a dyeing machine 2 for dyeing textile material. In the illustrative example of FIG. 1 the dyeing machine 2 is of a type which is called a jet-dyeing machine.

The addition device 1 according to the invention comprises substantially a control unit 3, which is more precisely described with reference to FIG. 2 and 3, and a pump unit 4 which is controlled by the control unit and is connected to an addition pipe 5 for addition of alkali to a dye bath in the dyeing machine from an addition container 6. This addition container 6 is on the top provided with a bar 7 with nozzles 8 for the supply of rinsing water via a valve 9 controlled by the control unit 3, which is connected to a supply pipe 10 for the rinsing water. The dye bath includes the dyeing agents dissolved in water. The material to be dyed in the form of for example an endless textile web is brought into the bath for the purpose of being dyed.

The pump unit 4 is in the above example a piston pump with a pump portion 4*a*, which is driven by means of a cylinder portion 4*b*. The pump portion 4*a* consists substantially of a cylinder and a reciprocating piston which is connected to the piston rod of the cylinder portion 4*b*. Below the piston in the piston portion the pump chamber is provided with an inlet, to which the addition pipe 5 is connected from an outlet 6*a* from the addition container 6, and an outlet 11 with which the addition pipe 5 communicates and extends from the outlet to the dye bath. On the inlet side and the outlet side respectively nonreturn valves 12, 13 are positioned which are so directed that the nonreturn valve 12 opens upon the suction stroke of the pump portion 4*a* when the nonreturn valve 13 is closed. When the piston in the piston portion 4*a* makes its pressure stroke, the nonreturn valve 12 is kept closed and the nonreturn valve 13 is kept open. In this way the content of the addition container 6 is fed forward to the dyeing bath over the addition pipe 5 in a carefully balanced dosage which is determined by the stroke length of the cylinder portion 4*b* (and consequently the stroke motion of the pump portion 4*a*) and on the speed of the stroke motion and also its stroke frequence, that is to say the number of strokes for each time unit, which is to be further described below.

The content of the addition container 6 consists of a prepared quantity of a treatment agent which is also more fully described below. The cylinder portion 4*b* is a double acting type and is preferably pneumatically driven and therefore an air hose 14, 15 is in a conventional manner connected to each end of the cylinder portion 4*b*, which hose is by means of the control unit 3 alternatively brought into communication with an air pressure source and is consequently placed under pressure resulting in that the required stroke motion is established. To the cylinder portion 4*b* are connected three limit switches, namely two end position switches 16, 17 and an intermediate position switch 18, said switches being positioned over one connection duct each in communication with a control unit 3 in order to accomplish an adjustment of a magnet valve for alternating supply of air to the air hose 14, 15. In accordance with a dosage cycle predetermined by means of programming the control unit 3 the pump unit 4 can be controlled to be switched over between different modes of operation. By means of sensing the positions the pump unit 4 can be brought to work with a half, alternatively a whole stroke length, involving a half pumped quantity for each stroke, or alternatively a whole pumped quantity for each stroke. The control of the stroke frequency can for example take place by the electric control pulses from the control unit 3 to an electric magnetic valve which will bring the same to alternatively place one or the other air hose 14, 15 under pressure by means of a variable alternating frequency. Conversion between a low and alternatively a high stroke speed can take place by means of for example connection of a choke valve in the air supply. By combining the control means it is possible to accomplish four modes of operation, namely a first mode of operation with a half stroke length, a low stroke speed and variable stroke frequency, a second mode of operation with a full stroke length, low stroke speed and a variable stroke frequency, a third mode of operation with a whole stroke length, a high stroke speed and a variable stroke frequence and a fourth mode of operation with a full stroke length, a high stroke speed and a variable stroke frequence. By combining these modes of operation a sequence control of the pump unit 4 can be accomplished by means of the control unit 3 so that after a predetermined time in the process a supply of the treatment agent to the dye bath is accomplished which supply is varied with respect to the supplied amount per time unit over a predetermined time interval. In this way an automatic, reproducable addition of treatment agents can be obtained in order to reach a maximum result in the shortest possible time. Other embodiments of the reprocess processes are described with reference to FIGS. 4 and 5.

With reference to FIGS. 2 and 3 the design and the actuation of the control unit 3 will be more precisely described. The control unit 3 requires for its function connection to an electric power source, which in the above example consists of the electrical power network. The control unit 3 is connected to the network over input terminals 40. The network is connected and disconnected respectively by means of a power supply switch 41. After the switch 41 a power unit 42 is connected which delivers to the electronic circuits and electromagnetically control valves the necessary power at for example 5 volts and 24 volts DC. The central part of the control unit 3 consists of a block, comprising a computer 43, an adaption unit 44, an input unit 45 and an output unit 46. The computer 43 is programmable for the control of the pump unit 4 shown in FIG. 1 to desired dosage by emitting electrical signals over the adaption unit 44 from the output unit 46 on its output terminals 47–58 in dependance on electrical signals on one or several of a plurality of input terminals 59–72 to the input unit 45 and in dependance of a preselected program. The panel 73 of the control unit 3 is provided with a display unit 74 which in three displays 75, 76, 77 shows accrued time at alternatively chosen positions by means of different switches 78–81 and 82–88.

The switch 78 is a switch for the choice of operations by means of which the apparatus can be switched between three different types of operation, namely a fully automatic operation in a first position for the switch, interval operation in a second position and continuous operation in a third position. The fully automatic operation involves control of the pump unit 4 in accordance with the invention, namely in accordance with predetermined processes with a dosage of the treatment agent varied over time. Interval operation involves adjusting the pump unit for work with a pre-set number of strokes per unit, that is to say 1–20 strokes per/min., interrupted with pause intervals. The third alternative, continuous operation involves a continuous dosage of the treatment agent at a certain number of strokes per minute, for example 1–20 strokes per minute which is pre-set manually and in this alternative there are no pre-set pause time. The number of strokes for each minute and the number of pauses per minute (at interval operation) is set, when the alternative interval operation and continuous operation has been chosen by means of the switch 81 and the two switches 82, 83. Initially the number of strokes per minute is for example set by the switch 81 in its set position, whereafter a desired value is set by means of one switch 82 causing an increase of the value upon actuation, or the other switch 83, causing a decrease of the value upon actuation. Set value is read in the display unit in the display 75, 76 and the preselected value is read into the computer 43. By means of the switch 79 there is selected between a certain number of pre-determined quantities of treatment agent which for example is 50, 100 or 200 liters as shown in FIG. 5. By means of the switch 80 one can chose between different timing intervals for the supply of treatment agent, as shown in FIG. 5 for example two intervals, namely 30 and 60 minutes respectively. When the chosen stroke frequency, number of strokes per minute, is read into the computer, the same display 75 is utilized in order to indicate accrued time by automatic operation, that is to say lapsed time for the addition of treatment agent. The display 77 shows the run time at interval operation. The switch 84 is a start swich by means of which the addition of treatment agent is started. By pressing the switch 85 it is before start selecting a rinsing sequency for rinsing the additional container 22 by means of rinse water after the finished process and for this purpose the valve 9, which for example is electromagnetically controlled is activated. The switches 87, 88 represent signals for alarm functions indicating for example that treatment liquid is introduced too soon or is left at the finish of the process. Numeral 86 represents a signal indicating that the process is finished.

The input terminals 59–70 include three pairs of connections 54–59, which are connected to the three limit switches 16, 17, 18 (see also FIG. 1). The input terminals 65, 66 are arranged for external start, and the input terminals 67, 68 are arranged for an external locking utilized in connection with a superior control system. The input terminals 69, 70 are arranged for connection to a level sensor for the addition container 6 for indication when the container is empty. The output terminals 47–56 include two output connections 47, 48 for connection to an electromagnetically controlled valve, mentioned above and included in the control unit 3 for alternation between air pressure supply to one or the other air hose 14, 15. The output terminals 49, 50 are connected to a choke valve which also is electromagnetically controlled and arranged to be connected by means of the control unit 3 at a programmed sequence for change of the operation mode of the pump unit 4 as described above. The choke valve can be pre-set in connection with the installation in order to for example produce a reduction of the pump speed in number of strokes per minute adapted for each application. The output terminals 51, 52 relate to connection to an external signal and the connections 53, 54 relate to external clear signal. The output terminals 55, 56 are connected to the electromagnetically controlled rinsing valve 9, which is shown in FIG. 1.

From FIGS. 4 and 5 is apparent that the added amount of dyeing agent per time unit increases with a lapsed time in accordance with chosen progression which secures the type of dosage in accordance with the present invention.

In order to adapt the progression of the addition optimally to the conditions of the present method, the progression preferably is made variable. For example one can base the addition of alkali by time on the following exponential function X:

$$X = A/\exp\,(InA/B\cdot(B-C)$$

which, for example in steps of 10% is mixed with a linear function Y=A/B·C.

X=Amount of addition according to the exponential function (liters).

Y=Amount of addition according to linear function (liters).

A=Alkali addition volume (liters).

B=Programme time (minutes).

C=Addition time (minutes).

The amount of addition X would for example be designated as 100% progression and the amount of addition Y can be designated as 0% progression.

The corresponding groups of curves are apparent from FIG. 4, showing 10 different degrees of progression from 0% to 100% and three different times for addition, namely 30, 60 and 90 minutes. The 0% progression is a linear function and is not included in the present invention.

The examples of FIG. 5 show six operational examples with approximately 70% progression at two different time intervals for the addition of fixing agent and with three different addition volumes. The two continuously drafted curves 90, 91 relate to an addition volume of 200 liters at an addition time of 40 and 60 minutes respectively. The two dotted and dashed curves 92, 93 relate to an addition volume of 100 liters at an addition time of 40 and 60 minutes respectively and the two dashed curves 94, 95 relate to an addition volume of 50 liters of fixation agent at an addition time of 40 and 60 minutes respectively. By the addition of caustic liquor the pH-value is changed and enables in the end phase a complete fixation.

In accordance with the invention these functions are accomplished by control of the pump unit 4 by means of the control unit 3 so that the pump unit is controlled in accordance with the different above described operation modes so that the chosen curve or function is followed. This takes place with a device operating during the alternative automatic operation which is set by means of the switch 78 on the panel of the control unit 3. The amount of addition is chosen by means of the switch 79 and the time for the addition is chosen by means of the switch 80. A dyeing process is started in which the necessary quantity of dye is added from a dye addition container of the dyeing apparatus to the water bath in the dyeing machine. The dyeing addition varies in accordance with the type of dye stuff and colour shade between 0.001–10 percentage of the total amount of material. Simultaneously the required amount of salt is added, for example sodium chloride or Glauber's salt in a quantity of for example 20–150 grams, preferably 30–80 grams per liter of the dye bath during a time interval of for example 10 minutes. The dye bath can be maintained during the whole process at a constant temperature of 20°–130°, preferably 30°–95°. The addition takes place during a continuous circulation of the dye bath 6 while the material web continuously is fed through the dye bath by the action of the jet stream which is formed by the streaming liquor in the treatment bath. After 10 minutes the addition of alkali is started by the addition device 1 according to the invention by means of the start switch 84 causing alkali to be initially added at a very small quantity per time unit by the control of the pump unit 4 in a first period of operation with half the stroke lengths and with a low stroke frequency. By conversion to the other operating modes the addition of alkali is is introduced in accordance with the pre-determined addition curve during the predetermined time interval. By means of the completely controlled progressive addition in accordance with the curves of FIGS. 4 and 5 a very level dyeing takes place and the whole total process time can be kept comparatively short and also the amount of chemicals and agents utilized can be reduced in comparison with prior art methods.

Those reactive dyeing agents primarily suitable for the method according to the present invention can for example be mono-, polyazo-, anthrachinon-, phtalocyanin-, formazan- or dioxazin-dying agents. They can be mono- and polyfunctional and can contain at least one of monochlortriazin-, dichlortriazin-, monofluortriazin-, vinylsulfon-, sulfatoethylsulfon-, dichlorchinoxalin-, trichlorpyrimidin-, monochlordifluorpyrimidin-, or vinylsulfonyl- or sulphatoetylsulfonylphenylamino-chlortriazingroups, whereas in the last group the chlor can also be replaced by fluor or can be replaced by amino- or oxybinding.

In the examples below reference is made to the dyestuffs exemplified by the following formulae:

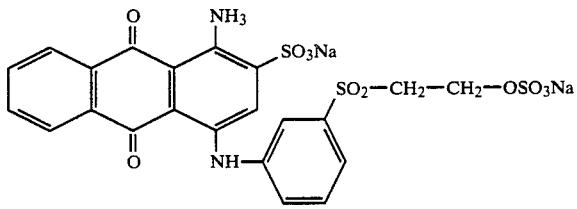

I

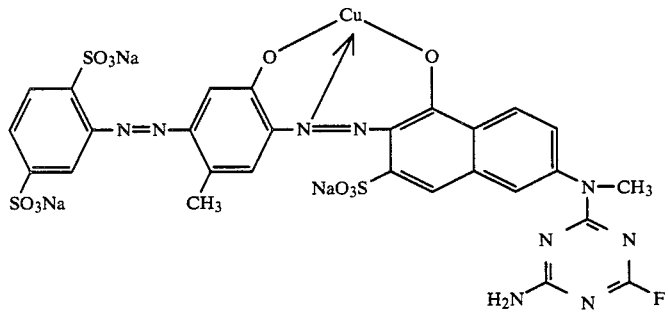

II

-continued

III

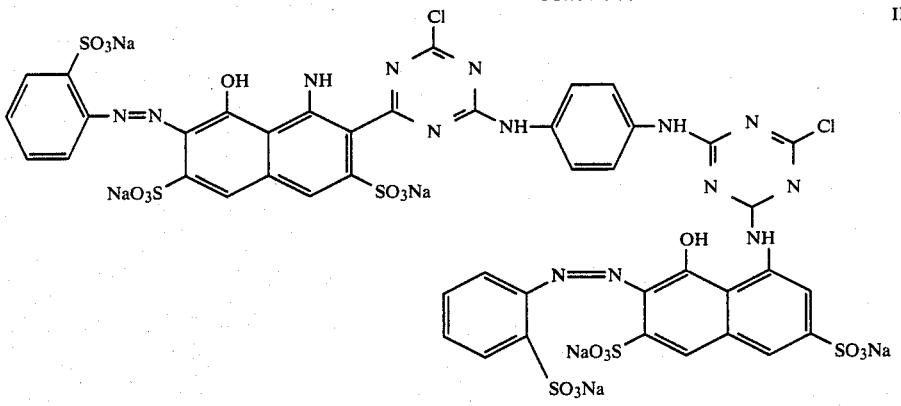

IV

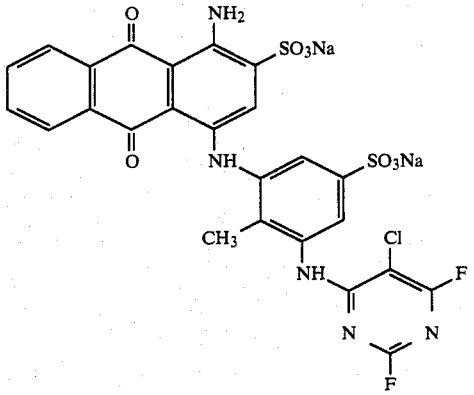

V

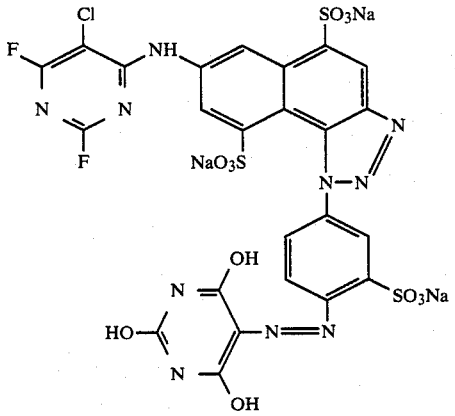

VI

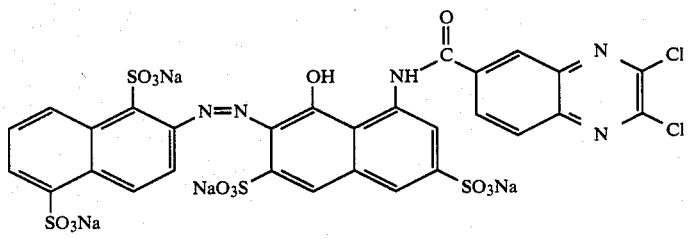

EXAMPLE 1

The dyestuff according to formula I is known for difficulties to attain evenness. It is usually not applied below 60° C. and as alkali at first sodium carbonate is added and later after continuous fixation caustic soda is added. A dying at 40° C., which is usual for sulfatoethylsulfon dyestuffs would upon usual merely adding caustic soda as alkali lead to a completely uneven dyeing.

The dyeing takes place in a dyeing machine which is in detail described above.

| | |
|---|---|
| Goods to be dyed: | Fine ripped knitted cotton fabric. |
| Material weight: | 300 kg |
| Dye bath: | 3000 liters |
| Dye stuff: | 2,5% of the product weight of commercial dyestuff corresponding to formula I. |
| Electrolyte: | 50 grammes/liter water free sodium sulfate. |
| Alkali: | 2 milliliters/liter of a caustic soda (sodium hydroxide) solution of 32,5 percentage by weight. |
| Dyeing temperature: | Constant 40° C. |
| Alkali addition volume: | 100 liters. |

-continued

| | |
|---|---|
| Programme time: | 60 minutes. |
| Progression: | 60% |

The dye base is adjusted to the temperature of 40° C. during addition of electrolyte. The addition of the previously dissolved dyestuffs takes place after that. This dye bath is transferred from the dyestuff container to the dyeing machine and the machine is started. The caustic soda solution is simultaneously added to the addition container 6 and the volume is set to 100 liters. After 10 minutes the device is manually started. After lapsed programme time the dyeing proceeds another 30 minutes. Thereafter for reactive dyestuffs usual final treatment follows in order to remove hydrolysates.

Result: A lively blue colour is obtained with an excellent evenness.

EXAMPLE 2

The dyestuff according to formula II is also known for its difficult evenness. Therefore it is not preferred to be utilized for difficult materials, for example mercerized cotton jersey.

The dyeing takes place in a winch dyeing machine, which is provided with bath circulation.

| | |
|---|---|
| Material to be dyed: | Mercerized cotton single jersey. |
| Material width: | 200 kg |
| Dye bath: | 3.500 liters |
| Dye stuff: | 3% of the product weight of the commercial dye stuff according to formula II. |
| Electrolyte: | 60 grams/liter sodium chloride |
| Alkali: | 1,5 milliliters/liter of a caustic soda solution of 32,5 percentage by weight. |
| Dyeing temperature: | Constant 40° C. |
| Alkali addition volume: | 200 liters |
| Programme time: | 90 minutes |
| Progression: | 80% |

The dye bath in the dyeing machine is adjusted to the temperature of 40° C. At first the dissolved dyestuff is added. After that the sodium chloride is added in a solid state. Simultaneously the caustic soda solution is added to the addition container and the volume is set to 200 liters. After 15 minutes the device is started manually and the chosen dosage programme is run to its end. After the lapsed programme time further dyeing takes place during 15 minutes at 40° C. Thereafter a final treatment follows for removal of hydrolysate which is connection with the dyestuff according to formula II must be made very carefully.

The result: One obtains a strong marine blue colour of an extraordinary evenness.

EXAMPLE 3

Light nuances of the dye stuff according to formula III results often in unevenness. At cheese dyeing machines with a single sided bath circulation a deep dyeing of the inner layers of the goods is avoided only in connection with a very careful procedure.

A dyeing in accordance with the present invention is carried out in such a yarn dyeing machine.

| | |
|---|---|
| Material to be dyed: | Mercerized cotton yarn in the shape of cross bobbins. |
| Material weight: | 300 kg |
| Dye bath: | 2.000 liters |
| Dye stuff: | 0,2% of a commercial dye stuff according to formula III |
| Electrolyte: | 20 grams/liter sodium chloride |
| Alkali: | 7,5 grams/liter trisodium phosphate in a crystalinic state. |
| Dyeing temperature: | Constant 80° C. |
| Alkali addition volume: | 100 liters |
| Programme time: | 60 minutes |
| Progression: | 70% |

The dye bath is brought to the temperature of 80° C. and then only the solved dyestuff is added. After that the material carrier is inserted and the same is treated during 10 minutes. Not until thereafter the sodium chloride is added with a time difference of 10 minutes in the form of two portions. This measure is advantageous in order to avoid the unevenness which can arise in connection with the drawing up phase in connection with the dyestuff according to the formula III. During the period therebetween the necessary trisodium phosphate is dissolved in the addition container and a volume of 100 liters is set. 10 minutes after the last addition of the sodium chloride the apparatus is connected with an external signal from a superior central control. After lapsed programme time the dyeing proceeds during a further 10 minutes at a temperature of 80° C. Thereafter the usual final treatment for the reactive dyeing takes place in order to remove the hydrolysates.

Result: From the outer and the inner layers of some of the cross bobbins a piece of yarn is removed and a circular knitting is carried out in a way that the inner and the outer layers are placed directly to each other. Neither visually nor colour metrically any differences in the tint will be discovered.

EXAMPLE 4

The dyestuff according to formula IV and especially formula V are known to be difficult to dye, primarily in combination with each other.

A dyeing of already made up cotton trousers is carried out in a drum dyeing machine. A little addition of dyestuff according to the formula VI takes place merely to establish a shading.

| | |
|---|---|
| Material to be dyed: | Made up cotton trousers |
| Material weight: | 50 kg |
| Dye bath: | 500 liters |
| Dye stuff: | 1% of the product weight of commercial dyestuff according to constitution IV.<br>1,35% of the product weight of the commercial dyestuff according to the constitution V.<br>0,2% of the product weight of the commercial dyestuff according to the constitution VI. |
| Electrolyte: | 40 grams/liter water free sodium sulphate. |
| Alkali: | 1 gram/liter sodium carbonate and 1 milliliter/liter of a caustic soda solution of 32,5 percentage by weight. |
| Alkali addition volume: | 50 liters |
| Programme time: | 30 minutes |
| Progression: | 30% |

The drum dyeing machine is charged with cold water and is heated up as fast as possible to the temperature of 50° C. During the heating at first the dissolved dyestuffs are added and thereafter the sodium sulphate. Simultaneously the mentioned alkalies are inserted into the addition container and are mixed therein and set to the volume 50 liters. Fifteen minutes after that the dyeing temperature has been attained in the dyeing machine, the device is started and the chosen dosage programme is run to its end. After lapsed program time a further treatment takes place during 20 minutes at the temperature of 50° C. Thereafter the usual final treatment takes place for the reactive dyestuffs.

Result: One obtains a covered green colouring with a splendid evenness and correctly with dyestuff penetrated threads.

The present invention is not limited to the above description. For example other types of dyeing machines can be used. Further, other pump types than piston types can be used, for example a rotational speed controlled gear pump.

The rinsing sequency can also be read into the display unit by means of a fourth position of the switch 81. By means of a battery back up, which can complete the control unit, the memories of the computer are maintained upon power interruption so that the process after interruption can continue where it was interrupted provided that a certain maximum time has lapsed during such interruption.

The progressive addition of alkali can be defined in alternative ways, for example the addition can be subproportional in an initial phase of the time interval which is changed to be over proportional in an end phase of the time interval. The amount/time-function must not be an exponential function. The progression can also be obtained by combining two or several linear functions so that in the initial phase there is a linear function with a reduced gradient (inclination) and in the end phase there is a linear function with a larger gradient.

I claim:

1. Apparatus for dyeing cellulose fibers and mixtures thereof with other fibers in a bath containing at least one reactive dyeing agent in the presence of an alkaline material for fixation of said dyeing agent comprising:

a vessel for containing a bath of cellulose fibers and a dyeing agent;

pump means for progressively adding an alkaline material to said vessel and bath; and control means for regulating said pump means to deliver an alkaline material automatically to said vessel progressively and in a substantially continuous manner over a predetermined time interval, said control means limiting the amount of said alkaline material so delivered in an initial phase of said time interval and increasing same to a largest amount in a final phase of said time interval until a sufficient amount of alkaline material has been delivered to said vessel to fix said dyeing agent on said cellulose fibers, and said control means including means for choosing between different timing intervals for the supply of alkaline material and for choosing between different degrees of progression for the supply of alkaline material.

2. Apparatus according to claim 1, further comprising an addition container for said alkaline material connected to said pump means, said pump means being a reciprocating piston pump, the length and frequency of the strokes thereof being electronically regulated by said control means in accordance with a predetermined program.

* * * * *